US012687168B2

(12) United States Patent
Nucci et al.

(10) Patent No.: US 12,687,168 B2
(45) Date of Patent: Jul. 21, 2026

(54) OPERATING ASSEMBLY FOR PUMPS FOR RECIRCULATING A COOLING FLUID OF COMBUSTION ENGINES AND RECIRCULATING PUMP PROVIDED WITH SUCH AN OPERATING ASSEMBLY

(71) Applicant: BARUFFALDI S.P.A., Tribiano (IT)

(72) Inventors: Niccolò Nucci, Tribiano (IT); Simone Rona, Tribiano (IT); Leonardo Molinari, Tribiano (IT); Marco Garbelli, Tribiano (IT)

(73) Assignee: BARUFFALDI S.P.A., Tribiano (IT)

( * ) Notice: Subject to any disclaimer, the term of this patent is extended or adjusted under 35 U.S.C. 154(b) by 14 days.

(21) Appl. No.: 18/844,751

(22) PCT Filed: Mar. 8, 2023

(86) PCT No.: PCT/IB2023/052201
§ 371 (c)(1),
(2) Date: Sep. 6, 2024

(87) PCT Pub. No.: WO2023/170603
PCT Pub. Date: Sep. 14, 2023

(65) Prior Publication Data

US 2025/0188936 A1 Jun. 12, 2025

(30) Foreign Application Priority Data

Mar. 9, 2022 (IT) ..... 102022000004493

(51) Int. Cl.
*F04D 13/02* (2006.01)
*F01P 5/12* (2006.01)
*F04D 13/06* (2006.01)

(52) U.S. Cl.
CPC ..... *F04D 13/024* (2013.01); *F01P 5/12* (2013.01); *F04D 13/026* (2013.01); *F04D 13/06* (2013.01)

(58) Field of Classification Search
CPC ..... F04D 13/024; F04D 13/026; F04D 13/06; F04D 13/0666; F04D 13/0673; F04D 13/021; F01P 5/12; F01P 7/162; F01P 2005/125; F01P 7/164
See application file for complete search history.

(56) References Cited

U.S. PATENT DOCUMENTS

2006/0131120 A1* 6/2006 Boffelli ..... F01P 7/048 192/48.2
2014/0174874 A1* 6/2014 Qin ..... F16D 48/064 192/66.32
2016/0040728 A1* 2/2016 Sakamoto ..... F16D 27/112 192/84.96
2017/0037853 A1* 2/2017 Modica ..... F01P 5/10

* cited by examiner

*Primary Examiner* — Dominick L Plakkoottam

(57) ABSTRACT

Operating assembly for a pump for recirculating a cooling fluid of a vehicle, comprising: an axially extending driven shaft (2) with a front end (2*a*) designed to carry the impeller (1) of a pump, at least one electromagnetic friction clutch (2), arranged between an element (21,21*a*) for taking up the rotational movement and the driven shaft (2), an electric drive for driving the driven shaft (2) independently of the movement take-up element, a support body (11;13) extending axially between a front part which carries the front end of the shaft (2) and a rear end which rotationally supports the movement take-up element, wherein the electric drive is axially arranged between the front end of the shaft and said movement take-up element.

11 Claims, 4 Drawing Sheets

OPERATING ASSEMBLY FOR PUMPS FOR RECIRCULATING A COOLING FLUID OF COMBUSTION ENGINES AND RECIRCULATING PUMP PROVIDED WITH SUCH AN OPERATING ASSEMBLY

BACKGROUND OF THE INVENTION

The present invention relates to an operating assembly for pumps for recirculating the cooling fluid of combustion engines, in particular of vehicles, with an operating device comprising an electromagnetic clutch and electric drive which is independent of the combustion engine, as well as to a recirculating pump provided with said operating assembly.

It is known in the sector for the production of engines, in particular combustion engines, that there exists the need to cool said engines by means of recirculation of a cooling fluid which is driven by means of a corresponding recirculating pump, the impeller of which is rotationally driven by a shaft operated by a pulley and a belt connected to the driving shaft.

It is also known that recirculation of the cooling fluid must be performed with a flowrate depending on the actual cooling requirement determined by the actual conditions of use of the engine and by the external temperature, in order to avoid the constant and unnecessary operation at full speed of devices which draw useful power, thereby increasing the wear of the various component parts and the consumption levels of the vehicle.

It is also known that, in order to solve this problem, devices have been proposed for controlling operation of the pump impeller shaft, rotation of which depends on the engagement of a friction clutch for transmission of a rotational movement depending on the speed of the driving shaft, and on an electric motor which is instead activated when the friction clutch is disengaged, for rotation of the impeller at a controlled speed independent of the driving shaft.

Although performing their function, these devices nevertheless have drawbacks which limit their applications, in particular since the known configurations have axial dimensions which are incompatible with the free volumes available inside the engine compartment, in particular as regards the limited amount of axial space available between the pump and the fan V which forces the air onto the cooling liquid contained inside the front radiator, these requiring respective drive belts for connection to the combustion engine in order to take up the rotational movement. The known solutions are moreover complex to produce and assemble.

SUMMARY OF THE INVENTION

The technical problem which is posed therefore is that of providing an operating assembly for pumps for recirculating cooling fluids for engines of vehicles and the like, able to produce a variation in the speed of rotation of the pump impeller depending on the actual operating requirement of the engine or any other systems which require cooling.

In connection with this problem, it is also required that the operating assembly should have a configuration designed to ensure overall dimensions of the pump equipped with this assembly such that there is a distance, in the axial direction, from the vehicle fan able to avoid damaging interference therewith.

A further object is that the pump operating assembly should be able at the same time to output high torques also when there is a low speed of rotation of the engine, so as to be applicable also to high-capacity pumps of heavy vehicles having an engine with a low number of revolutions, or rotation of the impeller at a low number of revolutions when the combustion engine is running at a high speed.

It is also required the device should be easy and inexpensive to produce and assemble and be able to be easily installed on the pump body without the need for special adaptation.

These results are obtained according to the present invention by an operating assembly for pumps for recirculating cooling fluids of engines for vehicles and the like.

The present invention relates furthermore to a pump for recirculating cooling fluids of engines for vehicles and the like equipped with such an operating assembly.

BRIEF DESCRIPTION OF THE SEVERAL VIEWS OF THE DRAWINGS

Further details may be obtained from the following description of a non-limiting example of embodiment of the subject of the present invention, provided with reference to the attached drawings in which.

DETAILED DESCRIPTION OF THE INVENTION

Figure 1:
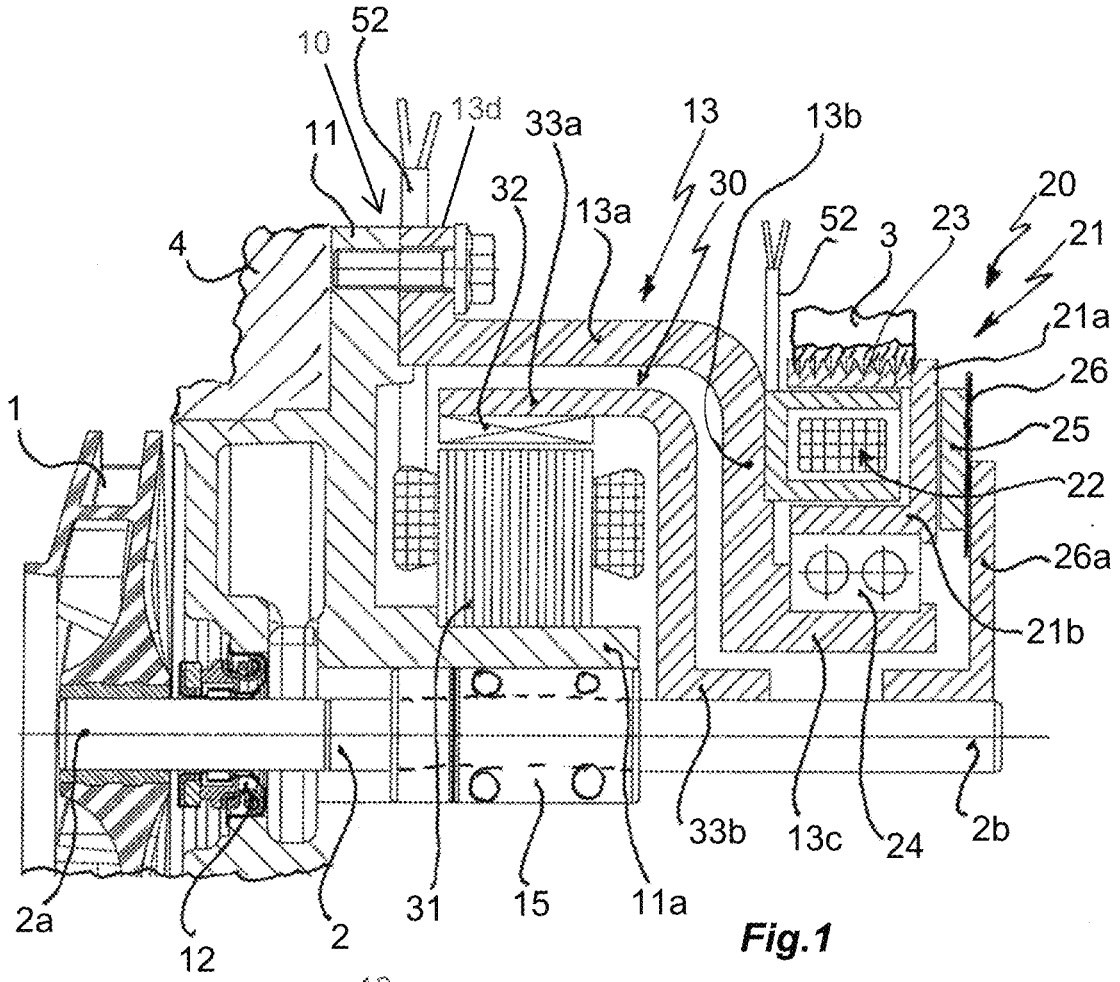
FIG. 1: is a cross-sectional view of a first example of embodiment of an operating assembly for a pump according to the present invention.

As shown in FIG. 1, the operating assembly comprises a shaft 2, on the front end 2*a* of which the impeller 1 of a pump for recirculating the cooling fluid of vehicles is mounted. The shaft 2 is supported by a fixed support body 10 rigidly joined to the base 4 of the vehicle engine.

The support body of the pump operating assembly comprises a first body part 11 which is situated proximal to the impeller and is fastened to the base 4. A sealing gasket 12, coaxial with the shaft 2, is arranged inside the first body part 11.

The first body part 11 supports said front end 2*a* of the shaft 2 and has, arranged inside it, a bearing 15, on the inner ring of which the impeller shaft 2 is keyed. In the preferred example of FIG. 1, said bearing 15 is a double bearing which entirely supports the driven shaft 2 and is keyed onto a radially inner axial sleeve 11*a* of the first body part 11.

The first pump body part 11 has, fastened thereto, a front end 13*d* of a bell member 13 which in the cross-sectional illustration is shown as being Z-shaped and comprises: a front axial and radially outer section 13*a*, a radial section 13*b* extending from the axial section towards the axis of rotation of the shaft 2 and an axial extension 13*c* extending form the radial section and axially distal from the impeller and designed to support an electromagnetic clutch 20.

In the preferred embodiment shown, the clutch 20 comprises:

- a fixed electromagnet 22 rigidly joined to the bell member 13. Preferably, the electromagnet 22 is in particular composed of a solenoid 22*a* (FIG. 2*a*) arranged inside a corresponding support 22*b* which is, for example, C-shaped and is in turn fastened to an outer rear end surface of the radial section 13*b* of the bell member 13;
- a rotor 21 in the form of an "overturned C" concentrically arranged so as to contain the electromagnet 22 inside it;
- an armature 25 arranged facing the electromagnet 22, with a front surface of the rotor 21 arranged between the electromagnet 22 and the armature 25.

The rotor 21 is supported by the said axial extension 13*a* of the bell member 13 with a bearing 24 arranged in between.

The radially outer section 21*a* of the rotor, opposite to the section 21*b* connected to the bearing 24, has, formed thereon, a pulley 23 suitable for coupling with a belt 3 so as to act as an element for taking up the rotational movement, for example transmitted by the shaft of the combustion engine, and for transmission thereof to said rotor 21, generating the movement for the pump shaft 2.

The armature 25 has, mounted on its face facing in the opposite direction to the electromagnet 22, an elastic lamina 26 fastened to a flange 26*a* in turn rigidly joined with the end of the shaft 2 opposite to that of the impeller 1; the lamina 26 and the armature 25 are therefore rotationally integral with the flange 26*a* and with the driven shaft 2.

By means of this connection, the armature 25 is able to perform movements in an axial direction towards/away from the rotor 21 so that, when the electromagnet 22 is energized, the armature 25 and the flange 26*a* are rotationally driven, but are instead stationary in the idle condition when the electromagnet 22 is de-energized.

As shown in FIG. 1, it is also envisaged that an electric drive, in particular an electric motor 30, is arranged in an axial position between the impeller 1 of the pump 10 and the electromagnetic clutch 20, being arranged inside the bell member 13.

In detail, the electric motor 30 comprises a stator 31 supported by the axial sleeve 11*a*, extending from the first support body part 11, and a rotor 32 mounted on a first axial extension 33*a* of a rotor flange 33 which has a Z-shaped form in cross-section and is designed to arrange the rotor in a position radially on the outside and concentric with respect to the stator for radial coupling therewith.

A second axial extension 33*b* of the rotor flange 33, opposite to the first extension, is integrally joined with the shaft 2 of the impeller 1.

It is pointed out that the pulling force of the belt 3 is transmitted onto the outer bearing 24 keyed onto the extension 13*a* of the fixed bell member 13 of the body 11, thus making it possible to limit the dimensions of the internal bearing 15 which is housed inside the first body part 11 and is not subject to the radial dynamic loads of the belt 3, but must support only the mass of the impeller and the rotor 32, 33, and of the armature 25 and associated flange 26*a*, thereby improving the working life of the transmission and helping limit the overall dimensions.

In addition, the constructional form of the pump support body consisting of two parts 11,13, with the bell member 13 which houses the electric motor and supports the movement take-up element 23 at a rear end, axially opposite to the impeller, helps simplify significantly the production and assembly process, with savings in terms of costs and material.

Figure 2A:
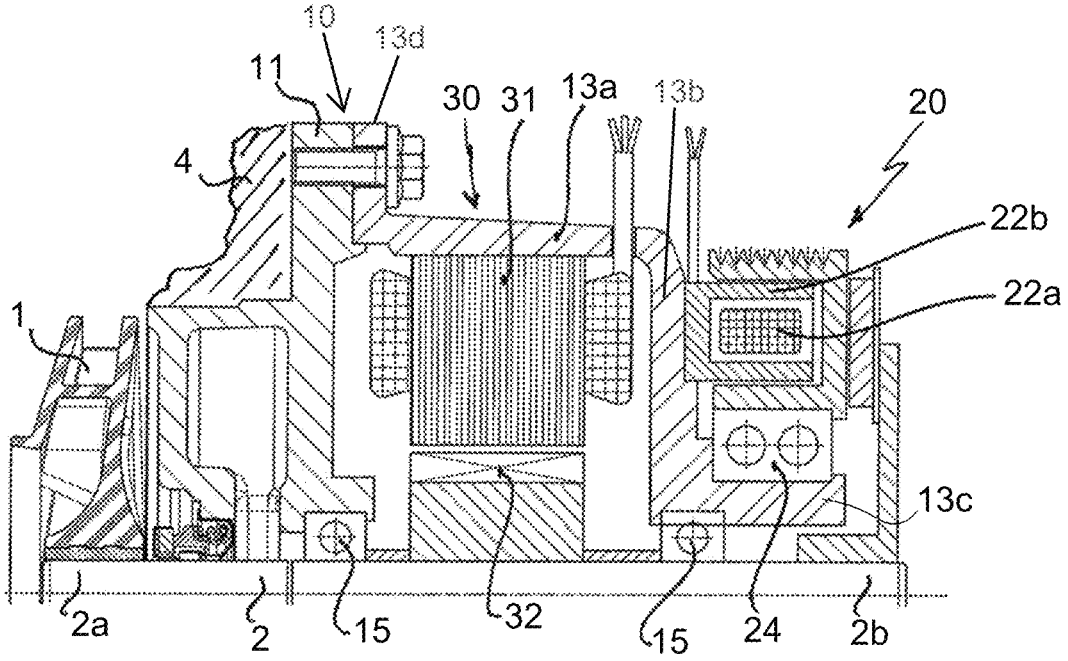
FIG. 2A: is a cross-sectional view of a variation of embodiment of the pump operating assembly according to FIG. 1.

As shown in FIG. 2A, in which the same reference numbers have been retained for functionally identical parts, a variation of embodiment of the assembly shown in FIG. 1 is envisaged, whereby in this case the stator 31 is mounted on the bell member in a radially outer position with respect to the rotor 32 integral with the shaft 2 of the impeller. A first bearing 15*a* is arranged between the shaft 2 and the first part 11 of the pump body, while a second bearing 15*b* is arranged between the axial extension 13*a* of the bell member 13 and the shaft 2, so as to allow the rotation of the shaft relative to the fixed parts of the assembly.

With this configuration comprising two separate bearings there is a better distribution of the stresses without an increase in the overall axial dimensions which remain contained within the volume of the bell member 13.

Figure 2B:
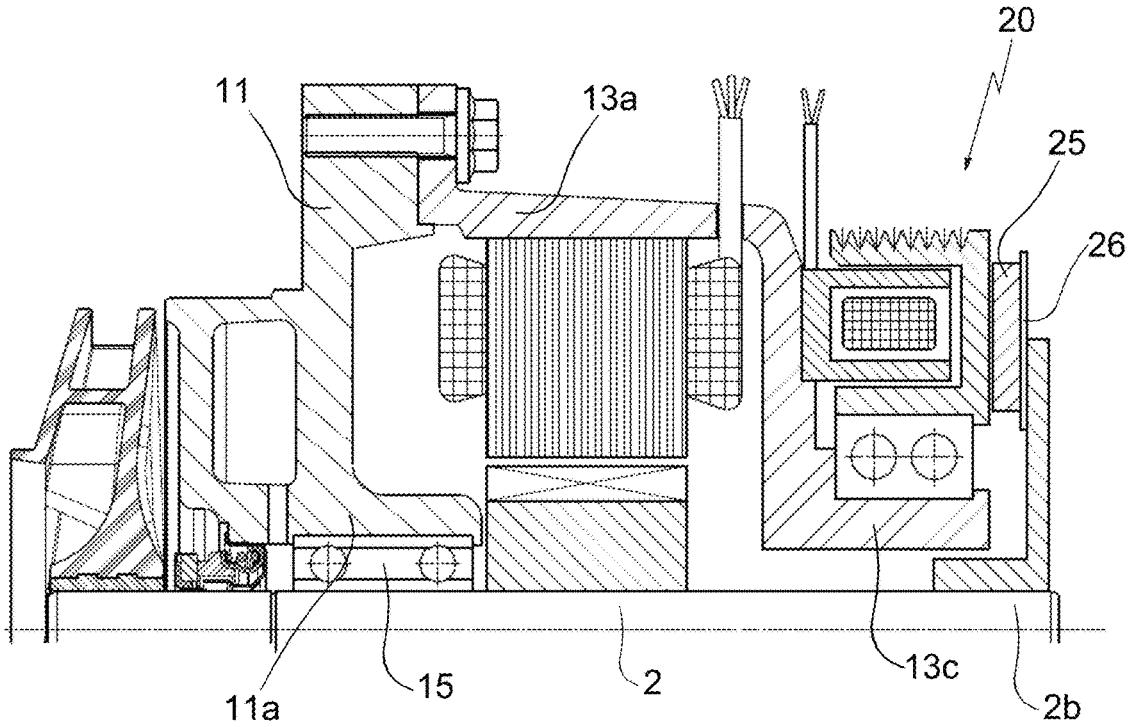
FIG. 2B: is a cross-sectional view of a further variation of embodiment of the pump operating assembly according to FIG. 1.

As shown in FIG. 2B, in variations of the embodiment of the pump shown in FIG. 2A, the driven shaft 2 may be entirely rotationally supported by a radially inner axial sleeve 11*a* of the first support body part 11 with the placing of a double bearing 15 in between, arranged in a position axially in front of the electric drive 30.

Figure 2C:
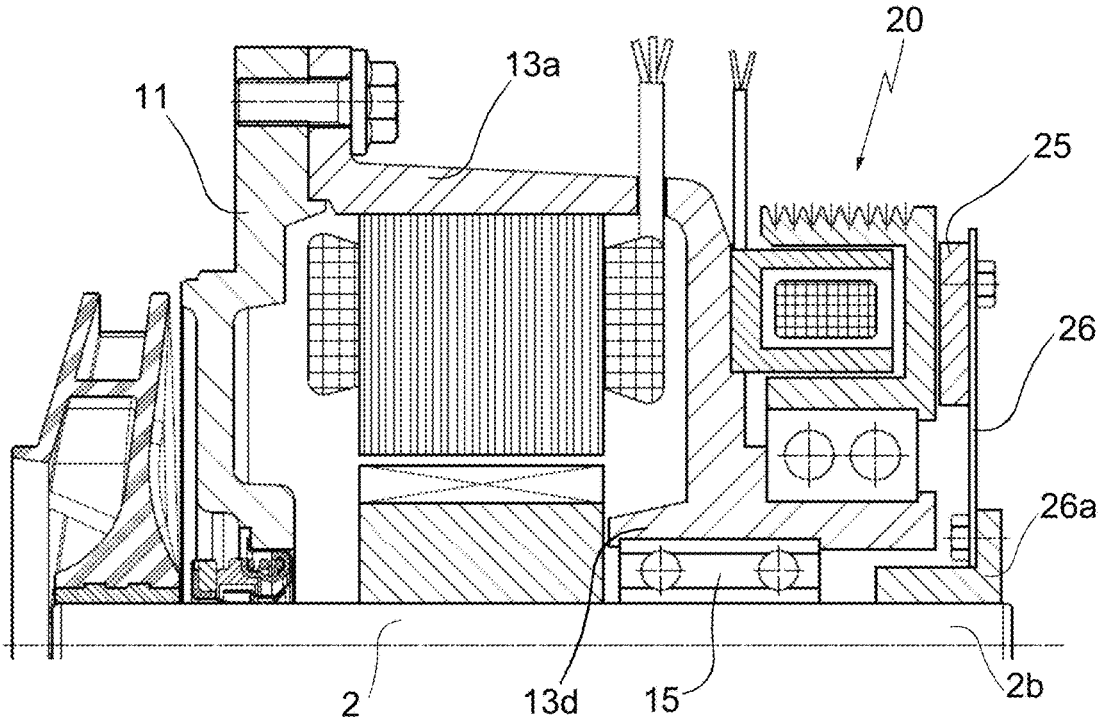
FIG. 2C: is a cross-sectional view of a further variation of embodiment of the pump operating assembly according to FIG. 1.

As shown in FIG. 2C, in further variations of embodiment of the pump according to FIG. 2A, the driven shaft 2 may be entirely rotationally supported by the bell member 13 of the support body, with the arrangement in between of a double bearing 15, which in the preferred example shown is mounted on the axial extension of the bell member which has a rear axial foot 13*c* which supports the rotor 21 of the electromagnetic clutch and a front axial foot 13*d*, these forming a radially inner axial sleeve on which the double bearing 15 is mounted.

The embodiments with double bearing 15 allow the process for production, assembly and maintenance of the pump to be further simplified, as well as being axially compact.

Figure 3:
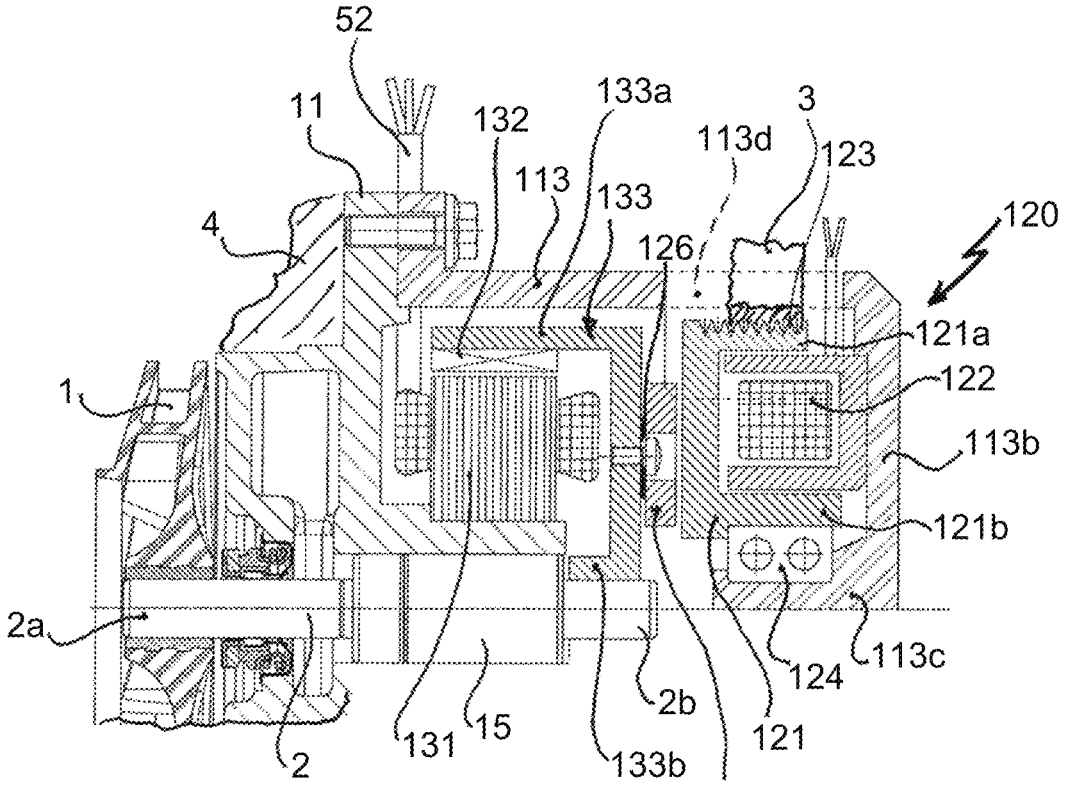
FIG. 3: is a cross-sectional view of a second example of embodiment of a pump operating assembly according to the present invention.

FIG. 3 shows a second embodiment of the pump assembly according to the invention which comprises in this case:

- a bell member 113, fastened to the first support body part 11, in turn fastened during use to the base 4, and therefore fixed, extending in the axial direction over a length such as to allow both the electromagnetic clutch 120 and the electric motor 130 to be contained inside it.

In detail:

the electromagnetic clutch 120 comprises:

- a fixed electromagnet 122, in particular comprising a solenoid arranged inside an associated support, for example in the form of an "overturned C", in turn fastened to a rear end surface of the radial section 113*b* of the bell member 113;
- a rotor 121 in the form of a "C" coaxial and partially concentric with the electromagnetic; the rotor having:
  - a radially outer section 121*a* shaped according to a movement take-up element, in particular a pulley 123, suitable for coupling with a belt 3 connected to a shaft of the combustion engine for transmission of the movement to the rotor; conveniently the bell member 113 has an axial opening 113*c* on the side surface of the axial section, designed to allow partial exposure of the pulley 123 and the passage of the belt 3 without interference;

a radially inner section 121*b* fastened to the outer race of a bearing 124, the inner race of which is fixed to a foot 113*a* of the bell member 113;

an armature 125 arranged axially opposite to the electromagnet on the opposite side to the rotor 121 and connected, via an elastic membrane 126, to the radial edge of a flange 133 connected to the shaft 2. Preferably, the flange 133 is also in the form of an "overturned C".

The electric motor 130 has a stator 131 fixed to a radially inner sleeve extending axially from the first body part 11 fixed to the base 4 of the combustion engine.

The electric rotor 132 is fixed to a radially outer axial section 133*a* of the flange 133, the other radially inner section 133*b* of which is connected to a free end 2*b* of the shaft 2 of the impeller 1.

This configuration therefore has the flange 133 for transmission of the movement arranged axially between the front electric motor and the armature 25, with the movement take-up rotor 121 in turn axially arranged between the armature 125 and the rear electromagnet 122.

For all the embodiments described it is envisaged that the electric power supply of the motor and the electromagnet is obtained by means of cables 52 connected to an electric power source of the motor.

With these configurations the operating principle of the impeller is as follows:

when the electromagnet 22,122 is energized, the magnetic field induced overcomes the elastic resistance of the lamina 26, 126, axially recalling the armature 25, 125 with the consequent engagement thereof with the rotor 21, 121 and driving of the shaft 2 of the impeller 1 at a given speed determined by the combustion engine via the belt 3 and the pulley 23,123;

when the electromagnet 22,122 is de-energized, the armature 25,125 is recalled by the elastic lamina axially away from the electromagnet 21,122, disengaging the rotor 21,121 from the armature, from the flange 26*a*, 133 and therefore from the shaft 2 of the impeller which remains in the idle condition;

if, in the idle condition of the shaft 2, a rotation of the impeller 1 at a speed independent of that determined by the combustion engine is required, the electric motor 30,130 is powered so that the movement of its rotor 32,132 causes the rotation of the shaft 2 at the desired speed of rotation suitable for determining recirculation of the fluid which is actually required.

Figure 4:
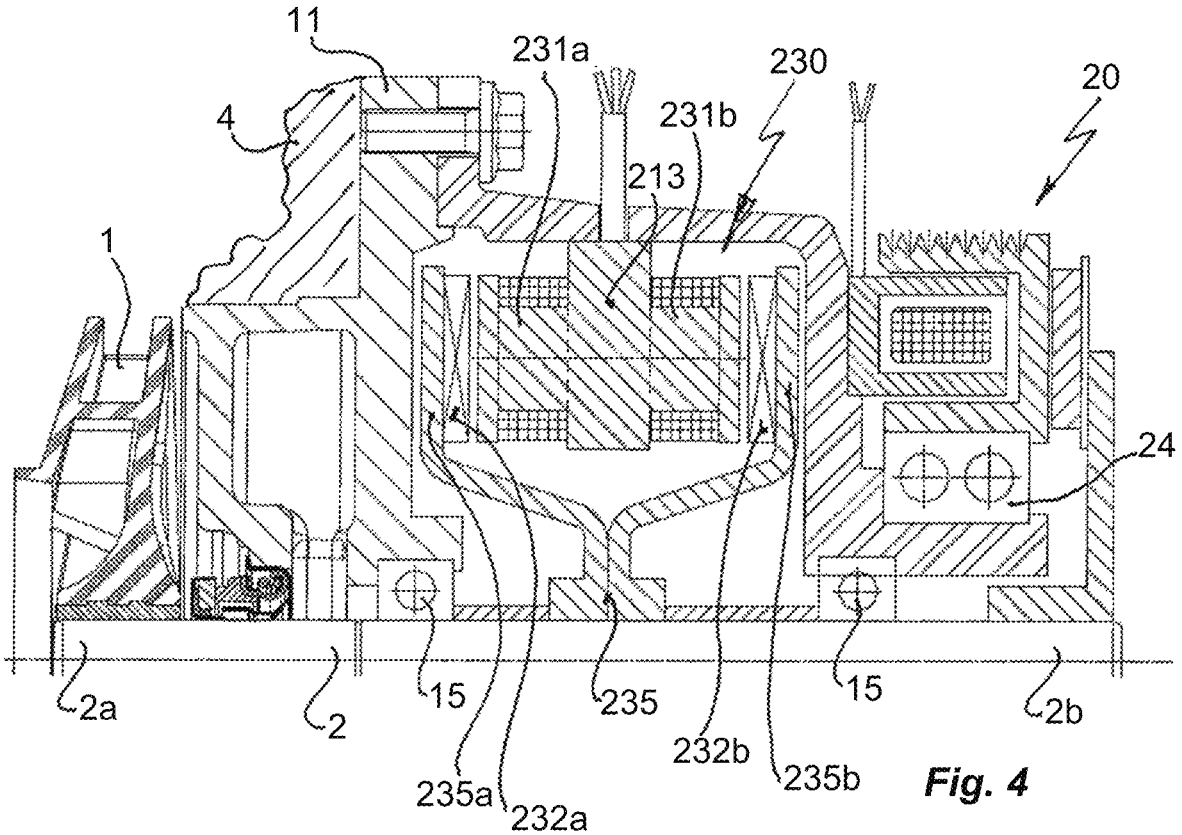
FIG. 4: is a cross-sectional view of a third example of embodiment of a pump operating assembly according to the present invention.

As shown in FIG. 4 a further embodiment according to the invention of the assembly for operating the impeller 1 of a recirculating pump is envisaged; while still keeping the same reference numbers for functionally equivalent parts, the assembly comprises an electric motor 230 with frontal coupling in the axial direction between stator and rotor.

In greater detail, the motor comprises two stators 231*a*, 231*b* which are mounted on a support 213 fastened to the fixed bell member 13. The two stators are arranged opposite each other in the axial direction for electromagnetic coupling with a respective axially outer front rotor 232*a*,232*b* respectively mounted on a corresponding arm 235*a*,235*b* of a fork 235 integral with the shaft 2 of the impeller 1.

The electric powering of both motors may be centralized by means of a single cable 52 for operation comparable to parallel tooth-by-tooth operation of the two stators 231*a*, 231*b*.

The other parts of the assembly correspond to those already described above in connection with FIGS. 1 and 2, and therefore the description will not be repeated, although fully referred to here.

Figure 5:
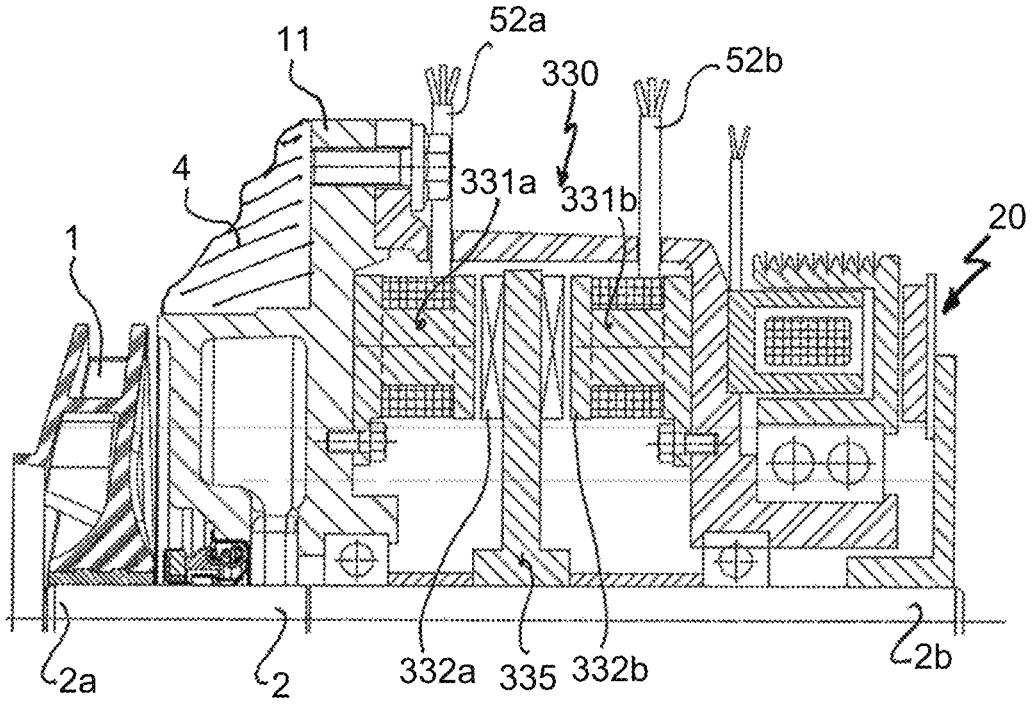
FIG. 5: is a cross-sectional view of a variation of embodiment of the pump operating assembly according to FIG. 4.

FIG. 5 shows a variation of embodiment of the assembly shown in FIG. 4; in this case the motor 330 comprises two stators 331*a*,331*b*, a first front stator is axially fastened to the first front body part 11 of the pump operating assembly and a second rear stator is axially fastened to the radial section of the bell member 13. The two stators 331*a*,331*b* are respectively oriented towards the inside for electromagnetic coupling with a respective rotor 332*a*,332*b*, both the rotors being mounted on a single flange 335 integral with the shaft 2 of the impeller 1.

In this embodiment, the two rotors 332*a*,332*b* are therefore arranged axially inside the stators.

The two motors are supplied 52*a*,52*b* independently of each other, allowing a broader range of regulation of the current, and therefore of the speed of the impeller, from a minimum (single motor) to a maximum (double motor).

The electromagnetic clutch with armature 25 rotationally integral with the driven shaft by means of a flange 26*a* and elastic lamina 26 gives rise to a structure which is extremely simple and compact to manufacture and assemble. Moreover this structure allows the movement take-up element 23 to be arranged in a rear position, substantially at the end of the pump assembly, maximizing the axial space between the impeller 1 and the movement take-up element, with significant advantages for the arrangement in relation to the belts for transmission of the movement to the cooling fan, which will be more fully described below with reference to FIG. 6. In addition, with the proposed structure of the electromagnetic clutch, it is possible to excite the electromagnet only when it is required to operate the shaft 2 and therefore the impeller with the movement transmitted by the movement take-up element 23; therefore energy savings and a longer working life of the clutch are achieved compared to so-called "failsafe" devices in which the electromagnet is constantly energized in order to keep the shaft and pulley disengaged. Advantageously, the failsafe function is achieved owing to the presence of two drives, i.e. an electric drive 30 and a mechanical drive 20, which ensure a sufficient redundancy in the event of malfunctioning of either drive.

Figure 6:
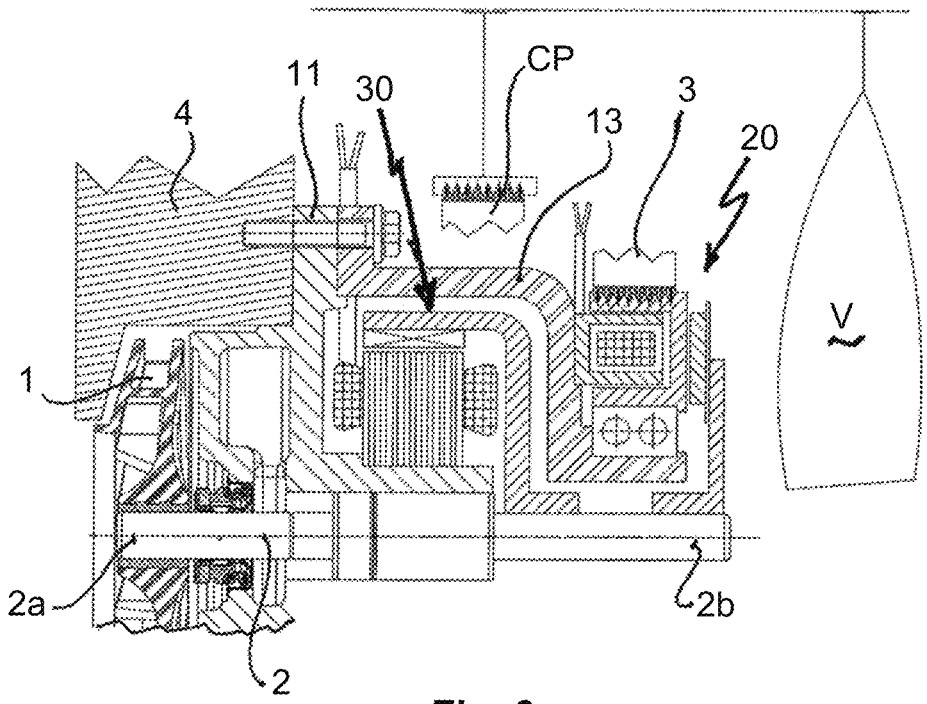
FIG. 6: is an overall cross-sectional view of the pump operating assembly installed with an adjacent cooling fan.

According to a preferred mode of implementation, the control of the excitation of the electromagnet 22,122 is performed place by means of the PWM (Pulse Width Modulation) technique involving modulation of the supply voltage, in order to supply a quantity (pulse) capable of overcoming the force of the elastic lamina resisting the recall action of the armature, and pulses with a short duration and quantity of current once the armature is attached to the electromagnet, requiring a reduced holding current; PWM is per se conventional and therefore not described in detail. FIG. 6 shows how with the innovative structures of the pump operating assembly it is possible to arrange the movement take-up element so that it is able be coupled with the secondary belt driving the pump impeller, in an axially outer, rear, position, opposite to the impeller, thus resulting in an axial length of the entire assembly such as to leave sufficient space without interference between the assembly itself and the fan V for cooling the fluid inside the front radiator, also making it possible to position the primary belt CP driving the fan in an axial position substantially corresponding to that of the electric motor situated radially below.

It is clear how the operating assembly for recirculating pumps according to the invention is able to ensure efficient driving of the pump impeller with recirculation of the vehicle cooling fluid which may be varied depending on the actual need by means of alternate operation by the combustion engine or by the auxiliary electric motor, while maintaining however, small radial dimensions which allow a pulley 21*a* also with a small diameter to be obtained, with consequent multiplication of the revolutions transmitted by the belt 3, thus making the device, and therefore the pump, suitable also for vehicles with engines which run at a low number of revolutions, but which require a high speed of rotation of the cooling pump.

In addition, the size of the pulley is not dependent on the size of the external diameter of the electric motor.

Although described in connection with an application relating to a water recirculating pump, it is understood that the cooling fluid could also be oil and that the operating assembly according to the present invention may therefore be used for an oil pump.

The invention claimed is:

1. An operating assembly for a pump with an impeller for recirculating a cooling fluid of a combustion engine of a vehicle, comprising a driven shaft extending axially with a front end designed to carry the impeller of the pump and rotating around an axis of rotation;

at least one electromagnetic friction clutch arranged between a movement take-up element for taking up a rotational movement from the combustion engine and the driven shaft;

an electric drive comprising a stator and a rotor for driving the driven shaft independently of the movement take-up element;

a fixed support body extending axially between a front part which carries the front end of the shaft and a rear end which rotationally supports the movement take-up element;

wherein the support body is made of two parts and comprises a first front body part which is proximal to said front end of the shaft and is designed to be fastened to a fixed base, and a bell member fastened to the first body part along a front end of the bell member extending radially away from the axis of rotation of the shaft and comprising an axial extension which supports the movement take-up element adjacent to the electromagnetic clutch via a bearing arranged in between, wherein said bell member further comprises a front axial and radially outer section extending axially fully between the front end of the bell member and a radial section of the bell member, the radial section extending from the front axial and radially outer section towards the axis of rotation of the shaft, and said axial extension extending from the radial section and is axially distal from the impeller, and wherein the stator of the electric drive is arranged inside the bell member and integral with the front axial and radially outer section of the bell member such that the front axial and radially outer section extends an entire axial length of the stator.

2. The operating assembly according to claim 1, wherein a first bearing is arranged between the shaft and the first front body part of the support body and a second bearing is arranged between the bell member and the shaft.

3. The operating assembly according to claim 1, wherein the electromagnetic clutch comprises:

a fixed electromagnet rigidly joined with the bell member;

a rotor which receives the rotational movement transmitted by the movement take-up element;

an armature arranged facing the electromagnet, with a front surface of the rotor arranged between the electromagnet and the armature.

4. The operating assembly according to claim 3, wherein the rotor of the electromagnetic clutch is supported by the said axial extension of the bell member via said bearing arranged in between.

5. The operating assembly according to claim 1, wherein said movement take-up element is a pulley formed on a radially outer section of a rotor opposite to a radially inner section supported on the bearing supported by the support body.

6. The operating assembly according to claim 1, wherein an armature of the electromagnetic clutch has, mounted thereon, an elastic lamina fastened to a flange in turn integrally joined with a rear end of the shaft opposite to the front end supporting the impeller, so that the armature is rotationally integral with the flange and the driven shaft, but is able to perform movements in the axial direction with respect to the driven shaft towards/from a rotor of the electromagnetic clutch.

7. The operating assembly according to claim 3, wherein, when the electromagnet is de-energized, the armature is recalled by an elastic lamina axially away from the electromagnet, disengaging the rotor from the armature so that the flange and the driven shaft remain idle, and, when the electromagnet is energized, an induced magnetic field overcomes the elastic resistance of the lamina, axially recalls the armature with the consequent engagement thereof with the rotor and rotational driving of the shaft of the impeller with the movement obtained from the movement take-up element.

8. The operating assembly according to claim 3, wherein the rotor is concentrically arranged so as to contain the electromagnet inside it.

9. A recirculating pump, comprising an operating assembly according to claim 1 and the impeller mounted on the front end of the driven shaft.

10. The operating assembly according to claim 1, wherein the shaft is rotationally supported by the first front body part with an arrangement of a first double bearing in between.

11. The operating assembly according to claim 1, wherein the shaft is rotationally supported by the bell member with an arrangement of a second double bearing in between.

* * * * *